US009427125B2

(12) United States Patent
McLuckie et al.

(10) Patent No.: US 9,427,125 B2
(45) **Date of Patent: *Aug. 30, 2016**

(54) VACUUM CLEANER

(71) Applicant: Dyson Technology Limited, Wiltshire (GB)

(72) Inventors: Paul Andrew McLuckie, Malmesbury (GB); Stuart Lloyd Genn, Malmesbury (GB); Jeremy William Crouch, Malmesbury (GA)

(73) Assignee: DYSON TECHNOLOGY LIMITED, Malmesbury, Wiltshire (GB)

( * ) Notice: Subject to any disclaimer, the term of this patent is extended or adjusted under 35 U.S.C. 154(b) by 439 days.

This patent is subject to a terminal disclaimer.

(21) Appl. No.: 13/917,416

(22) Filed: Jun. 13, 2013

(65) Prior Publication Data

US 2013/0333156 A1 Dec. 19, 2013

(30) Foreign Application Priority Data

Jun. 14, 2012 (GB) ..... 1210603.5

(51) Int. Cl.
*A47L 9/16* (2006.01)
*A47L 5/30* (2006.01)

(52) U.S. Cl.
CPC .. *A47L 9/16* (2013.01); *A47L 5/30* (2013.01); *A47L 9/165* (2013.01); *A47L 9/1658* (2013.01); *A47L 9/1683* (2013.01)

(58) Field of Classification Search
CPC ..... A47L 9/1683; A47L 5/28; A47L 9/1666; A47L 9/1691; A47L 9/127; A47L 9/16
See application file for complete search history.

(56) References Cited

U.S. PATENT DOCUMENTS

2008/0047091 A1* 2/2008 Nguyen ..... 15/300.1
2011/0056045 A1* 3/2011 Sepke ..... A47L 5/28 15/347
2011/0219572 A1* 9/2011 Conrad ..... 15/347
2013/0333155 A1* 12/2013 McLuckie ..... A47L 9/1608 15/347
2014/0053368 A1* 2/2014 Gammack et al. ..... 15/353

FOREIGN PATENT DOCUMENTS

GB 2 372 433 8/2002

OTHER PUBLICATIONS

GB Search Report dated Sep. 26, 2012, directed to GB Application No. 1210603.5; 1 page.

* cited by examiner

*Primary Examiner* — Robert Scruggs
(74) *Attorney, Agent, or Firm* — Morrison & Foerster LLP

(57) ABSTRACT

A vacuum cleaner has a removable cyclonic separator that includes a cyclone chamber; a dirt-collection chamber, open at one end; and an outlet duct from the cyclone chamber. An open end of the outlet duct is arranged for connection to a motor intake duct on the cleaner, the outlet duct and dirt collection chamber sharing a common wall section which divides the open end of the outlet duct from the open end of the dirt collection chamber. A cover closes off the open end of the dirt collection chamber and can be opened to allow access to the dirt collection chamber for emptying. When the cover is in the closed position, a cover sealing member forms an air seal between the cover and the common wall section. When the outlet duct is connected to the motor inlet duct, an outlet duct sealing member forms an air seal between the ducts.

18 Claims, 5 Drawing Sheets

PRIOR ART

VACUUM CLEANER

REFERENCE TO RELATED APPLICATIONS

This application claims the priority of United Kingdom application No. 1210603.5, filed 14 Jun. 2012, the entire contents of which are incorporated herein by reference.

FIELD OF INVENTION

The present invention relates to the field of cyclonic vacuum cleaners. The invention finds particular application in a cyclonic upright vacuum cleaner, but may also be applied to other cyclonic cleaners.

BACKGROUND OF THE INVENTION

Cyclonic vacuum cleaners work using cyclonic action to separate out dust and dirt from the dirty air sucked into the cleaner. They generally comprise at least one cyclonic chamber in which the air spins at high speed under the prevailing vacuum pressure, and a respective dirt collection chamber which is arranged to collect the dirt flung out from this fast-spinning airflow. The cyclone chamber and dirt collection chamber are together referred to as a cyclonic stage of separation.

The separation efficiency of a cyclonic stage varies with particle size. Consequently, in order to deal with the range in particles sizes typically found in household dust, a tuned series of cyclonic stages is typically provided. In this sort of multi-stage arrangement, the first stage tends to remove the relatively large particles and then each successive stage is optimized to remove successively smaller particles. The various stages may be packaged together as a single, cyclonic separator, which may be removable from the vacuum cleaner to allow easy emptying of the dirt collection chambers. FIG. 1 shows a typical example of this sort of general arrangement. Here, the vacuum cleaner 1 is an upright vacuum cleaner and a removable multi-stage cyclonic separator 3 is mounted in an upright position on a rolling support assembly 5 forming part of the cleaner 1.

FIG. 2 is a section through the cyclonic separator 3. Here the first cyclonic stage—or 'primary'—comprises a relatively large, cylindrical bin 7 which acts both as a cyclone chamber and as a dirt-collection chamber. The second cyclonic stage comprises a plurality of smaller, tapered cyclone chambers 9 arranged in parallel (to reduce pressure losses across the secondary stage) which each feed into a second dirt collection chamber 11—the so-called Fine Dust Collector (FDC).

The dirty air enters the bin 7 through a tangential inlet 13 (shown in FIG. 1) to help impart the necessary spin to the airflow inside the bin 7, and the separated dirt collects at the bottom of the bin 7. The air exits the primary through a cylindrical mesh outlet—or 'shroud'—15 and from here is ducted to the secondary cyclone stage. The air exits the secondary cyclone chambers 9 through the top and is then collected in a manifold 17 and ducted down through the bottom of the cyclonic separator—via a sock filter 19 (for separating very fine particles remaining in the airflow)—to the vac-motor.

The outlet duct 19 and the FDC 11 share a common circular wall, which divides the annular, open end of the FDC 11 from the circular open end of the outlet duct 19. The use of a common dividing wall between the FDC 11 and the outlet duct 19 provides for a compact arrangement.

The base 23 of the cyclonic separator 3 is hinged (the hinge itself is not visible in FIG. 1) to allow the user to empty the contents of the bin 7 and the FDC 11 simultaneously. To ensure an adequate air seal between the base and the walls of the FDC, an annular gasket 25 is provided on the base which compresses against the bottom ends of the inner and outer walls of the FDC 11. Similarly, a flexible, annular lip seal 27 is provided to create a seal between the base 23 and the outer wall of the bin 7.

A drawback has been identified with the scheme shown in FIG. 1. The drawback is that, if the annular gasket 25 between the base 23 and the inner wall 21 of the FDC 11 fails, this then introduces a short circuit between the inside of the FDC 11 and the motor intake—indicated by the dotted arrow in FIG. 1. Consequently, fine dust in the FDC 11 may be drawn in through the motor intake, with the potential risk of damage to the motor.

SUMMARY OF THE INVENTION

According to the present invention, there is provided a vacuum cleaner comprising a removable cyclonic separator, the separator comprising: a cyclone chamber; a dirt-collection chamber, open at one end; an outlet duct from the cyclone chamber, an open end of the outlet duct being arranged for connection to a motor intake duct on the cleaner, the outlet duct and dirt collection chamber sharing a common wall section which divides the open end of the outlet duct from the open end of the dirt collection chamber; a cover which closes off the open end of the dirt collection chamber and which can be opened to allow access to the dirt collection chamber for emptying; a cover sealing member which, when the cover is in the closed position, forms an air seal between the cover and the common wall section; and a duct sealing member which, when the outlet duct is connected to the motor inlet duct, forms an air seal between the two ducts.

In accordance with the invention, two independent sealing members are provided: a cover sealing member to form an air seal between the cover and the common wall section and a separate duct sealing member to provide an air seal between the two ducts. Consequently, failure of either one of the sealing members does not necessarily create a short circuit between the dirt collection chamber and the motor, despite the fact that the dirt collection chamber and outlet duct share a common wall section. As a result, the risk of damage to the motor caused by dust ingress is significantly reduced.

The cover sealing member may be arranged to seal off the open end of the dirt collection chamber entirely, or may just seal against the common wall section (with separate provision being made to seal the remainder of the perimeter of the dirt collection chamber as required).

In the arrangement in FIG. 2, the motor intake is connected directly to the FDC 11, across the air-seal formed by the gasket 23—consequently, failure of the gasket 23 will necessarily result in a 'short-circuit' (fluid connection) between the motor intake and the FDC 11. To avoid this situation, the motor intake duct may be arranged in accordance with another aspect of the present invention so that it connects directly to atmosphere across the air-seal formed by the duct sealing member. Consequently, this creates a leakage path from atmosphere directly into the motor intake duct in the event of failure of the air-seal. The leakage path bypasses the cyclonic separator altogether: in effect, the motor intake short-circuits to atmosphere if the duct sealing member fails. There is no closed path between the motor intake duct and the dirt collection chamber, across the air-seal formed by the duct sealing member. Ingress of fine dust from the dirt collection chamber into the motor intake is significantly reduced, even if both sealing members fail.

The open end of the outlet duct may be arranged to fit over the end of the motor intake duct in order to form a bypass leakage channel between the walls of the ducts, which channel connects the motor intake duct to atmosphere. This is a convenient arrangement for connecting the motor intake duct to atmosphere and the outlet duct also advantageously cowls the entrance to the motor intake duct. In this arrangement, the motor intake duct can also be extended a considerable distance up inside the outlet duct, if desired.

The duct sealing member may be arranged so that it sits inside the leakage channel formed between the ducts. In a particular arrangement, the duct sealing member is fixedly mounted on the outside of the motor intake duct and is arranged to form a seal against the inside of the outlet duct. The duct sealing member may be a lip seal.

The dirt-collection chamber may be an annular chamber surrounding the outlet duct. The entire wall of the outlet duct may then be a common wall constituting the inner wall of the dirt collection chamber. This is a particularly compact configuration.

The cover may likewise be annular and the outlet duct may extend through the annular cover. In this case, the cover sealing member may be provided along the inner rim of the cover to seal against the outside of the wall of the outlet duct—this sort of "face-sealing" arrangement tends to make it easier to close the cover than a gasket-type arrangement, in which the user must compress the seal as the cover closes. The seal can also conveniently take up radial assembly tolerances between the cover and the outlet duct. In addition, because the sealing member is arranged to seal against the outside of the wall of the outlet duct—rather than being a gasket which compresses between the cover and end of the outer wall—the sealing member is able to make sealing engagement before the cover is fully closed and can therefore provide a seal along the common wall between the outlet duct and the dirt collection chamber even when the cover is not fully closed. A gasket may nevertheless be provided on the cover for compression between the outer wall of the dirt collection chamber and the cover.

The cover sealing member itself may be a flexible lip seal provided along the inner rim of the annular cover, though other types of "face-seals" may be used, such as brush seals.

The dirt collection chamber may be connected directly to atmosphere across the air-seal formed by the cover sealing member.

In another arrangement, the separator may additionally comprise an inlet duct, the inlet duct being arranged for connection to a dirty-air duct on the cleaner, wherein the inlet duct and the outlet duct share a common wall section which divides the open ends of the inlet duct and the outlet duct, and a second duct sealing member is provided which, when the inlet duct is connected to the dirty air duct, forms an air seal between the inlet duct and the dirty air duct. Again, two independent sealing members are provided: a first duct sealing member to form an air seal between the outlet duct and the motor intake duct, and a second duct sealing member to form an air seal between the inlet duct and the dirty air duct. Consequently, failure of either one of the sealing members does not necessarily create a short circuit between the dirty-air duct and the motor intake duct, despite the fact that these ducts share a common wall. As a result, the risk of damage to the motor caused by dust ingress is significantly reduced.

If the motor intake duct is connected to atmosphere across the air-seal formed by the outlet duct sealing member, then there will be no closed path between the dirty-air duct and the motor intake duct across the air-seal formed by the outlet duct sealing member. The dirty-air duct cannot consequently be short-circuited to the motor intake duct as a consequence of failure of both duct sealing members.

The open end of the inlet duct may fit over the end of the dirty-air duct. The inlet duct sealing member may be fixedly mounted on the outside of the dirty-air duct and be arranged to form a seal against the inside of the inlet duct. The inlet duct sealing member may be in the form of a lip seal.

If the dirt collection chamber is an annular chamber, then it may be arranged to surround both the inlet duct and the outlet duct. Again, this is a particularly compact arrangement.

The inlet duct and the dirt collection chamber may additionally share a common wall section which divides the open end of the inlet duct from the open end of the dirt collection chamber. This common wall section and the common wall section between the dirt collection chamber and the outlet duct may together form the inner wall of the annular dirt collection chamber.

The cover may likewise be annular, in which case the cover sealing member may seal against the inner wall of the dirt collection chamber. The cover sealing member may be a flexible lip seal provided along the inner rim of the annular cover.

BRIEF DESCRIPTION OF THE DRAWINGS

Embodiments of the invention will now be described, with reference to the accompanying drawings, in which.

DETAILED DESCRIPTION OF THE INVENTION

Figure 1:
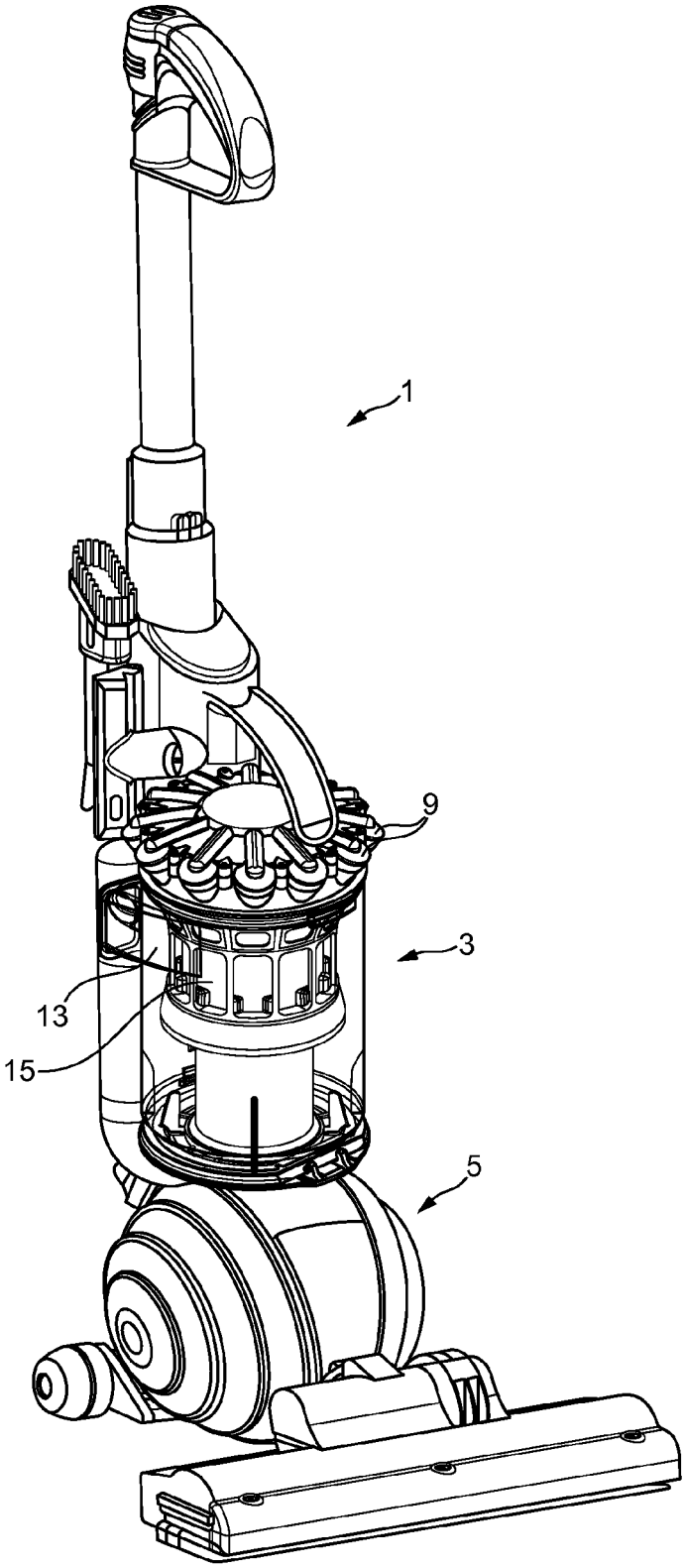
FIG. 1 is a perspective view of a conventional vacuum cleaner.
Figure 3:
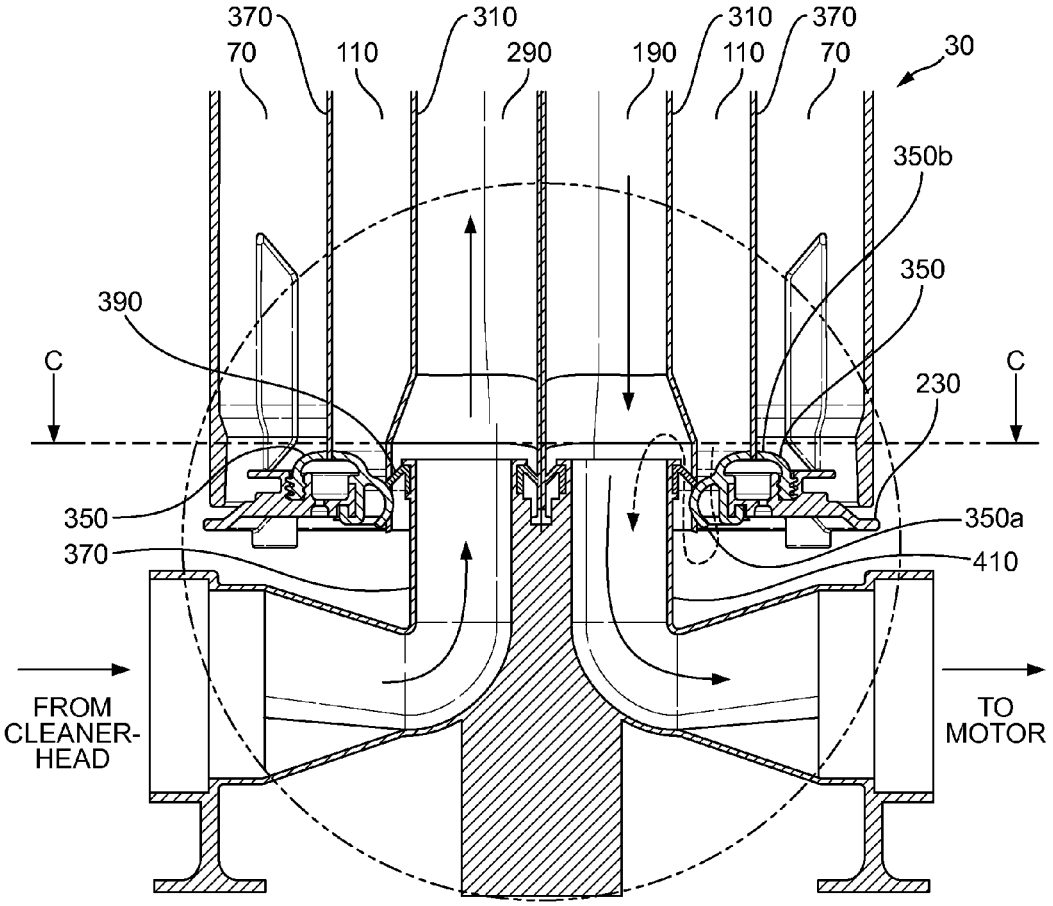
FIG. 3 is a sectional view of the bottom part of a cyclonic separator according to the present invention.
Figure 4:
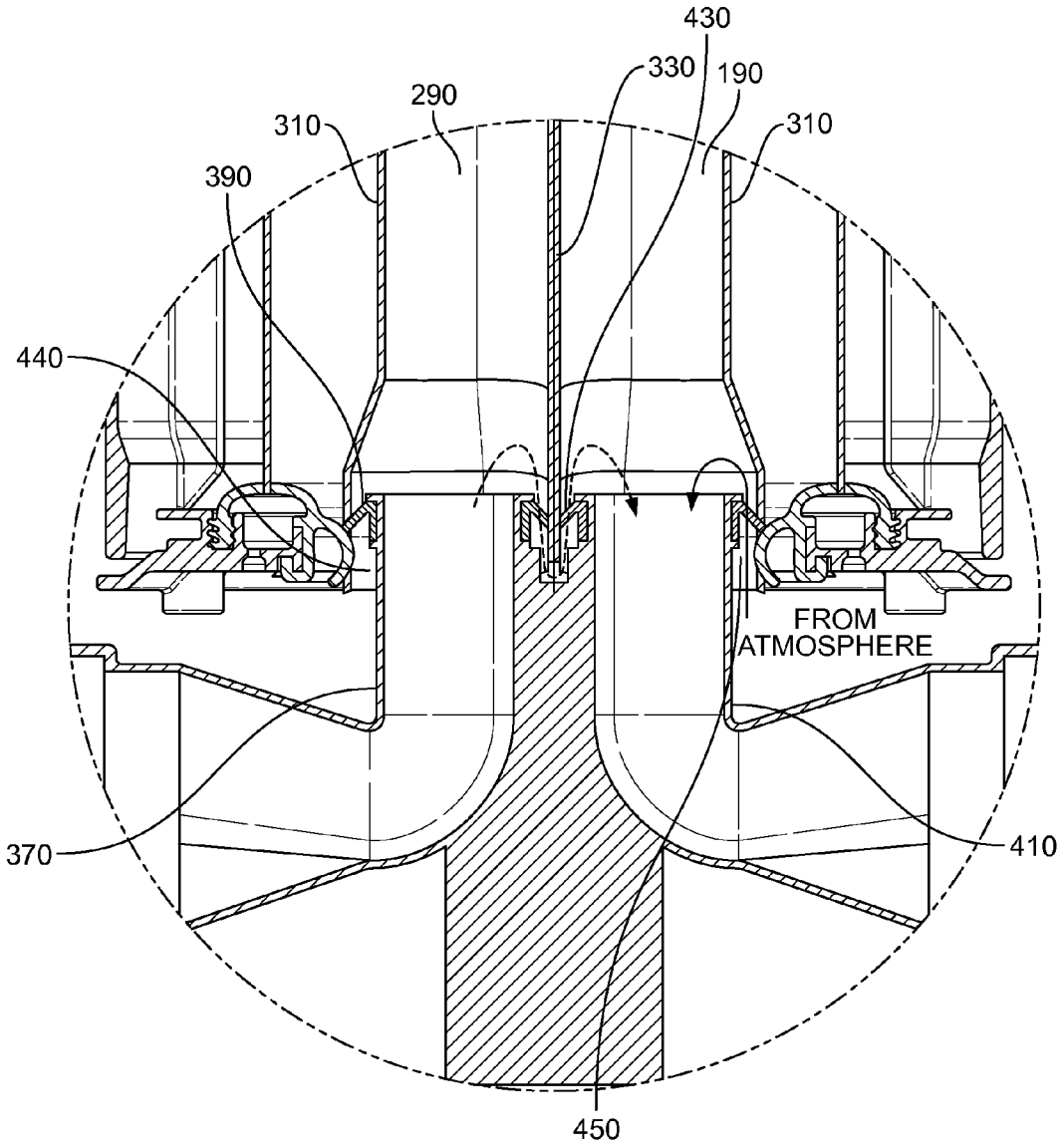
FIG. 4 is a magnified sectional view of the area circled in FIG. 3.
Figure 5:
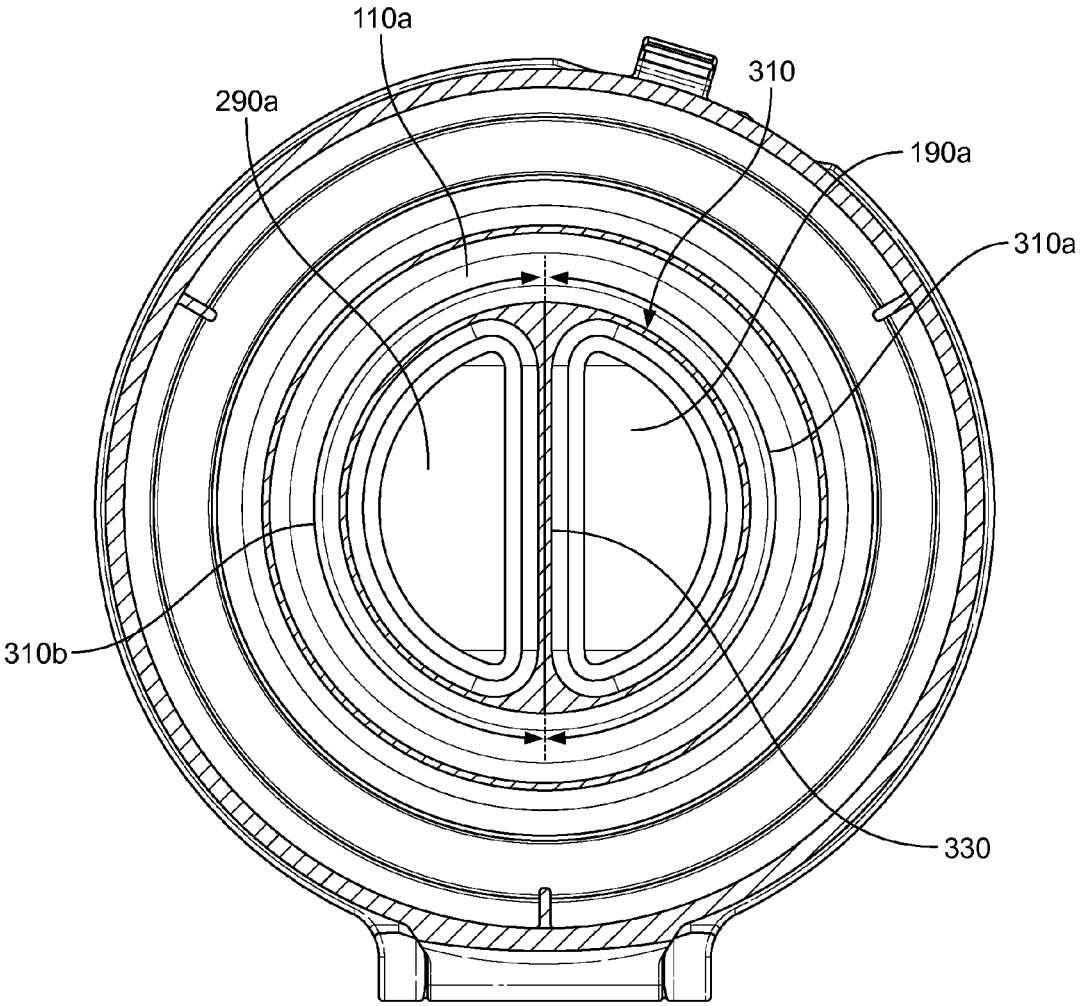
FIG. 5 is a sectional view taken along C-C in FIG. 3.

FIGS. 3 to 5 illustrate the bottom part of a cyclonic separator 30 on a vacuum cleaner in accordance with the invention. Comparing the separator 30 to the conventional separator 3 shown in FIG. 1, the separator likewise comprises an annular, outer cylindrical bin 70 which constitutes the primary cyclone stage, an annular inner dirt collection chamber 110—referred to below as the FDC—which is fed by a respective plurality of second-stage cyclone chambers (not shown) and an outlet duct 190 which takes the air from an exit manifold (not shown) at the top of the cyclone separator 30 and ducts this air down through the base 230 of the cyclonic separator 30, to the motor, as indicated by the arrow.

Figure 2:
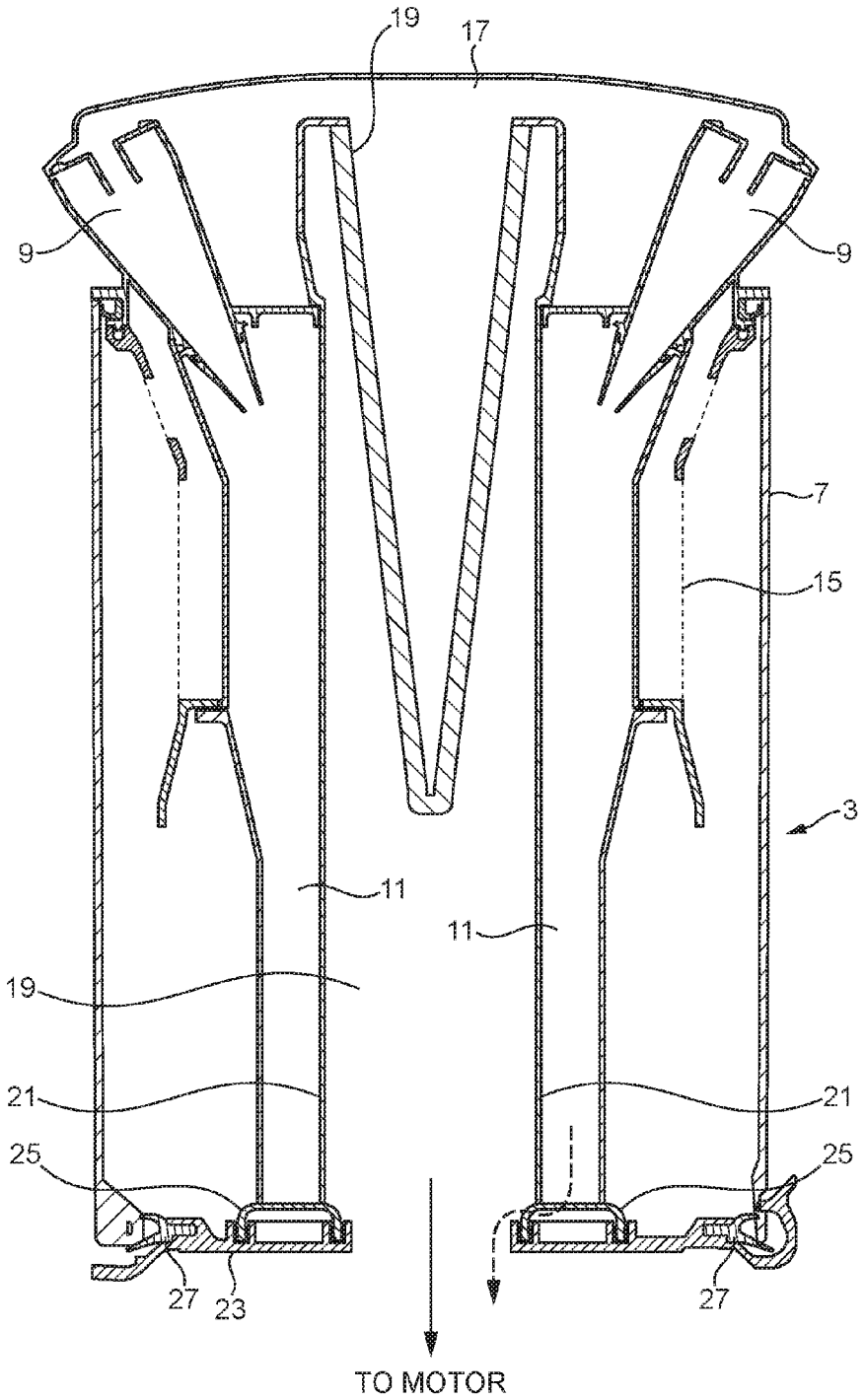
FIG. 2 is a sectional view through a conventional cyclonic separator.

The cyclonic separator 30 differs from the separator shown in FIG. 2 in that the dirty air is also delivered to the primary up through the base of the cyclone separator—again, indicated by an arrow in FIG. 3—so that there is actually also an inlet duct 290 running immediately alongside the outlet duct 190.

The outlet duct 190 shares a section of the circular inner wall 310 with the FDC 110. This common wall section **310*a*** divides the open end 190*a* of the outlet duct 190 from the annular open end 110*a* of the FDC 110. The inlet duct 290 likewise shares a section of the circular inner wall 310 with the FDC 110. This common wall section 310*b*divides the open end 290*a* of the inlet duct 290 from the annular open end 110*a* of the FDC 110.

In addition, the inlet duct 290 and the outlet duct 190 together share a common wall section 330, which divides the open ends 190*a*, 290*a* of the ducts 190, 290. This common wall section 330 runs diametrically, so that the two ducts 190, 290 each have a corresponding semi-circular cross section (the corners of the semi-circle are in each case blended to reduce pressure losses), but this is not essential: the common wall section 330 could be arranged along some other chord line of the circular wall 310, for example.

The base 230 takes the form of an annular, hinged cover which is provided to close off the annular open end 110*a* of the FDC 110. The annular area of the cover 230 is such that, in this example, the cover 230 also closes off the annular open end of the outer bin 70. This provides for simultaneous emptying of the FDC 110 and the outer bin 70, but is not essential: a separate cover may be provided for the bin 70.

The circular inner wall 310 of the FDC 110 extends through the central hole in the annular cover 230 when the cover 230 is in the closed position, shown in FIG. 3.

An annular, cover seal member 350 is provided on the upper surface of the cover 230. This cover seal member 350 comprises a flexible sealing lip 350*a* which is arranged to form an air-seal between the cover and the outside surface of the circular wall 310 when the cover 230 is in the closed position. The cover seal member 350 additionally incorporates an annular gasket part 350*b* which seals against the lower end of the outer wall 370 of the FDC 110*a* to form an air-seal between the cover 230 and this outer wall 370. Consequently, the cover 230 seals off the open end of the FDC 110 in the closed position.

The inlet duct 290 slidably engages an up-duct 370 on the vacuum cleaner (a sliding engagement is used so as not to hinder removal of the cyclonic separator 30 from the vacuum cleaner as and when required: the ducts simply slide apart). This up-duct 370 is a dirty-air duct—upstream of the cyclonic separator 30—which ducts dirty air drawn in through the cleaner head to the cyclonic separator 30. An inlet duct sealing member 390 is provided, near the upper end of the dirty-air duct 370, in the form of a flexible lip seal. This lip seal 390 seals against the inside of the inlet duct 290 on the cyclonic separator 30, forming an air-seal between the inlet duct 290 and the dirty-air duct 370.

The outlet duct 190 likewise slidably engages an up-duct 410 on the vacuum cleaner. This second up-duct 410 is a motor intake duct—downstream of the cyclonic separator 30—which ducts clean air exiting the outlet duct 190 to the intake on the main vac-motor. An outlet duct sealing member 430 is provided, near the upper end of the motor intake duct 410, in the form of a flexible lip seal. This lip seal 430 seals against the inside of the outlet duct 190 on the cyclonic separator 30, forming an air-seal between the outlet duct 190 and the motor intake duct 410.

The cover seal member 350 and the outlet duct sealing member 430 act independently from one another. Consequently, both seals are required to fail in order to short circuit the FDC 110 and the motor intake duct 410 (indicated by the dotted arrow in FIG. 3). This is therefore a more reliable sealing arrangement than the conventional sealing arrangement described in FIG. 2.

Similarly, the inlet duct sealing member 390 and the outlet duct sealing member 430 act independently from one another. Consequently, both seals are required to fail in order to short circuit the dirty air duct 370 and the motor intake duct 410 (indicated by the dotted arrow in FIG. 4).

In fact, the specific arrangement described is designed so that a short circuit between the FDC 110 and the motor intake duct 410 is unlikely even in the event of failure of both the cover sealing member 350 and the outlet duct sealing member 430. This is because the motor intake duct 410 connects directly to atmosphere across the air-seal formed by the outlet duct sealing member 430. Consequently, failure of the duct sealing member 430 creates a bypass leakage path (indicated by the solid arrow in FIG. 4) which short-circuits the motor intake duct 410 to atmosphere, bypassing the FDC 110. This significantly reduces dust ingress into the motor intake duct 410 if both sealing members 350, 430 fail, because in effect there is no closed path between the FDC 110 and the motor intake duct 410 across the air-seal formed by the outlet duct sealing member 430.

Similarly, short circuit between the dirty-air duct 370 and the motor intake 410 is unlikely to occur because there is likewise no closed path between the dirty-air duct 370 and the motor intake duct 410: the outlet duct sealing member 430 fails to atmosphere.

The motor intake duct 410 connects to atmosphere via an annular bypass channel 450 which is formed between the wall of the outlet duct 190 and the wall of the motor intake duct 410 extending inside the outlet duct 190. The outlet duct sealing member 430 sits in the bypass channel 450 and, along with the duct walls, effectively forms an annular, open-ended plenum cavity at atmospheric pressure.

In the specific arrangement shown in FIGS. 3 to 5, the dirty-air duct 370 is also connected to atmosphere, via a respective annular bypass channel 470 in similar manner to the motor intake duct 410, so that the dirty-air duct likewise short-circuits to atmosphere if the inlet duct sealing member fails. However, this is not necessary to prevent a closed path forming between the dirty-air duct 370 and the motor intake duct 410 if the motor intake duct 410 is itself connected to atmosphere across the air-seal formed by the outlet duct sealing member 430.

The FDC is additionally connected to atmosphere, across the air-seal formed by the cover sealing member 350, so that the FDC short circuits to atmosphere in the event of failure of the cover sealing member 350. Again, this is not really necessary for preventing a closed path forming between the FDC 110 and the motor intake duct 410 if the motor intake duct 410 is itself connected to atmosphere across the air-seal formed by the outlet duct sealing member 430.

The invention claimed is:

1. A vacuum cleaner comprising a removable cyclonic separator, the separator comprising: a cyclone chamber; a dirt-collection chamber, open at one end; an outlet duct from the cyclone chamber, an open end of the outlet duct being arranged for connection to a motor intake duct on the cleaner, the outlet duct and dirt collection chamber sharing a common wall section which divides the open end of the outlet duct from the open end of the dirt collection chamber; a cover which closes off the open end of the dirt collection chamber and which can be opened to allow access to the dirt collection chamber for emptying; a cover sealing member which, when the cover is in the closed position, forms an air seal between the cover and the common wall section; and an outlet duct sealing member which, when the outlet duct is connected to the motor inlet duct, forms an air seal between the ducts.

2. The vacuum cleaner of claim 1, wherein the motor intake duct connects directly to atmosphere across the air-seal formed by the outlet duct sealing member, in order to create a bypass leakage path between atmosphere and the motor intake duct if the air-seal fails.

3. The vacuum cleaner of claim 2, wherein the open end of the outlet duct fits over the end of the motor intake duct to form a bypass leakage channel between the walls of the ducts, which channel connects the motor intake duct to atmosphere across the air seal formed by the outlet duct sealing member.

4. The vacuum cleaner of claim 3, wherein the outlet duct sealing member sits inside the bypass leakage channel.

5. The vacuum cleaner of claim 4, wherein the outlet duct sealing member is fixedly mounted on the outside of the motor intake duct and forms a seal against the inside of the outlet duct.

6. The vacuum cleaner of claim 1, in which the dirt-collection chamber is an annular chamber surrounding the outlet duct.

7. The vacuum cleaner of claim 6, in which the cover is likewise annular and the outlet duct extends through the annular cover.

8. The vacuum cleaner of claim 7, in which the cover sealing member seals against the outside wall of the outlet duct.

9. The vacuum cleaner of claim 8, in which the cover sealing member is a flexible lip seal provided along the inner rim of the annular cover.

10. The vacuum cleaner of claim 8, in which a gasket is additionally provided on the cover for sealing against an outer wall of the dirt collection chamber.

11. The vacuum cleaner of claim 1, wherein the separator comprises an inlet duct, the inlet duct being arranged for connection to a dirty-air duct on the cleaner, wherein the inlet duct and the outlet duct share a common wall which divides the open ends of the inlet duct and the outlet duct, and an inlet duct sealing member is provided which, when the inlet duct is connected to the dirty air duct, forms an air seal between the inlet duct and the dirty air duct.

12. The vacuum cleaner of claim 11, wherein the open end of the inlet duct fits over the end of the dirty air duct.

13. The vacuum cleaner of claim 12, wherein the inlet duct sealing member is fixedly mounted on the outside of the dirty-air duct and forms a seal against the inside of the inlet duct.

14. The vacuum cleaner of claim 11, wherein the inlet duct and the dirt collection chamber additionally share a common wall section which divides the open end of the inlet duct from the open end of the dirt collection chamber.

15. The vacuum cleaner of claim 11, in which the dirt collection chamber is an annular chamber surrounding both the inlet duct and the outlet duct.

16. The vacuum cleaner of claim 15, in which the common wall section between the inlet duct and the dirt collection chamber and the common wall section between the outlet duct and the dirt collection chamber together define an inner wall of the dirt collection chamber.

17. The vacuum cleaner of claim 15, in which the cover is likewise annular and the cover sealing member seals against the inner wall of the dirt collection chamber.

18. The vacuum cleaner of claim 15, wherein the cover sealing member is a flexible lip seal provided along the inner rim of the annular cover.

* * * * *